United States Patent [19]

Salvatore

[11] Patent Number: 4,981,450

[45] Date of Patent: Jan. 1, 1991

[54] CONNECTOR APPARATUS

[75] Inventor: Amedeo Salvatore, Napoli, Italy

[73] Assignee: Texas Instruments Incorporated, Dallas, Tex.

[21] Appl. No.: 294,337

[22] Filed: Jan. 6, 1989

[51] Int. Cl.[5] ..... H01R 13/187

[52] U.S. Cl. ..... 439/844; 439/886; 439/843; 439/856

[58] Field of Search ..... 439/819, 821, 851–857, 439/886, 887, 891, 885, 843, 844

[56] References Cited

U.S. PATENT DOCUMENTS

| | | | |
|---|---|---|---|
| 2,190,824 | 2/1940 | Cook | 439/886 |
| 4,662,702 | 5/1987 | Furuya | 439/886 |
| 4,718,166 | 1/1988 | DeFilippis et al. | 339/262 R |
| 4,822,288 | 4/1989 | Conley | 439/887 |

*Primary Examiner*—David L. Pirlot
*Attorney, Agent, or Firm*—John A. Haug; James P. McAndrews; Melvin Sharp

[57] ABSTRACT

A high reliability low cost connector has flat retainers blanked from an electrically conductive sheet metal and inserted into an opening in an electrically insulating body. Each retainer has a post at one end extending from an opening at one side of the body and has a pair of integral wings spaced from each other in a plane at its opposite end disposed in the opening at an opposite side of the body. Spring clips are blanked and formed from an electrically conductive sheet metal spring material and are inserted into the body openings so loop portions of the clips fit between the pairs of retainer wings in each opening and are biased into resilient electrical engagement with the retainer wings. Each clip preferably has two pairs of juxtaposed spring leaves integral with the loop spaced at 90° relative to each other around a common axis to grip a terminal inserted between the spring leaves. The loops are also formed with interruptions in each loop in a common location between two adjacent spring leads. The sheet metal retainers and clips are inserted into the body openings while suspended from support strips left during the blanking steps and are then separated from the support strips. In that way the retainers and clips have predetermined uniform orientations in the openings.

7 Claims, 3 Drawing Sheets

CONNECTOR APPARATUS

BACKGROUND OF THE INVENTION

This invention includes subject matter contained in coassigned U.S. Pat. No. 4,718,166 which issued Jan. 12, 1988.

The field of this invention is that of connectors used in mounting multi-terminal integrated circuit units on printed circuit boards and the invention relates more particularly to a low cost connector adapted for applications requiring high reliability.

Connectors for mounting multi-terminal integrated circuit units on printed circuit boards conventionally have contact members mounted in openings in a molded electrically insulating body. The contact members have a post extending from one side of the body to be connected in an electrical circuit and has spring means on the opposite end of each contact member to resiliently grip integrated circuit terminals inserted into the body openings. When such connectors are intended for military applications and the like requiring particularly high performance reliability, the contact members are typically formed in two parts. One part comprises a post formed by screw machine from a brass rod or the like and has an axial bore in one end of the post. A spring clip formed of conductive spring material is then pressed into the bore and is adapted to resiliently engage an i.c. terminal inserted into the bore. Two part contact members of this type are mounted in individual body openings and provide high performance but the contact members are relatively expensive to manufacture and are particularly expensive to assemble with the connector bodies. Further, the spring clips inserted into the contact members typically comprise a ring of spring material having pairs of springs leaves depending from the rings to make resilient engagement with i.c. terminals inserted into the rings. Such rings usually have an interruption in the ring and that interruption as well as the spring leaves usually have random locations in the post bores so the connectors are frequently limited to use with round i.c. terminals or the like. It would be desirable if such high performance connectors could be manufactured and assembled at lower cost and could be adapted for use with strip type i.c. terminals for providing a high reliability performance in many other potential applications.

SUMMARY OF THE INVENTION

It is an object of this invention to provide a novel and improved high reliability low cost connector; to provide such a connector having a structure which is characterized by high performance; to provide such a connector which is adapted for use with round or strip type terminals; to provide such a connector having a structure which is characterized by ease of manufacture; and to provide novel and improved methods for manufacturing such connectors.

Briefly described, the novel and improved connector of this invention is made by blanking a plurality of retainers from a strip of electrically conductive sheet metal material such as steel, brass, copper or the like. Each retainer is blanked so surface portions of the retainer are juxtaposed in spaced facing relation to each other. Preferably the retainers are blanked so they initially remain connected to and supported by portions of the strip material which are left during the blanking step. Preferably the retainers are blanked flat and each comprises a pair of wings which are disposed in spaced, side-by-side relation to each other in a plane at one end of the retainer. In that way, respective edge surfaces of the wings are juxtaposed in spaced facing relation to each other. Preferably the retainers are also provided with a flat post which extends from a pair of wings in the same plane. If desired, detents are raised on the spaced facing edge surfaces of the wings adjacent the distal ends of the wings.

A plurality of spring clips are also blanked and formed into selected configuration from a strip of electrically conductive sheet metal spring material such as beryllium copper, stainless steel, phosphor bronze or the like. Each clip is blanked and formed to have a loop portion and to have a plurality of integral spring leaves extending from the loop in juxtaposed relation to each other. Preferably the clips are blanked from the strip materials so they initially remain connected to and supported by portions of the strip which are left during the blanking step. Preferably each clipped loop has two pairs of juxtaposed spring leaves arranged 90° apart around a common axis and the clip loops have interruptions at common locations on the loops between two adjacent spring leaves.

The spring clip is plated with gold on a surface which, when the clip is formed, will be on the inside and with tin on a surface which, when the clip is formed, will be on the outside of the loop. The retainer is plated with tin to facilitate soldering of the post to a circuit board as well as to provide an electrical path between the retainer and the clip having low electrical resistance.

An electrically insulating body is also provided with an opening for receiving a retainer and a spring loop. Preferably for example the body is molded of glass-filled nylon or other suitably rigid electrical insulating material or the like so that a plurality of openings are provided in the body spaced in two rows along the length of the body so the openings extend between opposite sides of the body.

In assembling the connectors, a group of the retainers is positioned over the body and the retainers are inserted into the respective body opening so that the retainer posts preferably extend from an opening at one side of the body and so that pairs of retainer wings are disposed in the respective opening at the opposite sides of the body. Preferably the body openings are provided with pairs of notches, the notches being disposed at opposite sides of the opening and being oriented in the openings so that the notches in each row of openings are disposed in a common plane extending along the length of the connector body. The retainers are then inserted into the body openings while still attached to the support means provided in the blank strip metal so the outer edges of the retainer wings are received within the notches for positioning the retainers with selected orientations in the body openings. The support strip means are then separated from the retainers by breaking or another conventional manner. The spring clip means are then inserted into the body opening so that the looped portions of the clips are received between the pairs of wings on the retainers in the respective openings to be held between the wings biased into resilient electrical engagement with the retainers. Preferably the clips are inserted into the body openings while still attached to the support means provided during the blanking step and are pressed between the retainer wings to be held between them by the detents provided on the wings so that the clips are positioned in the body openings with a common and precisely precisely predetermined orientation in the openings. The support strip means are then removed from the spring clips by breaking or another conventional manner. In that way the spring leaves provided on the clips and the interruption in the spring clip loops are oriented in the connector body so the connector is adapted to receive strip-shaped i.c. terminals and to make selected face and edge engagement with such terminals.

DESCRIPTION OF THE DRAWINGS

Other objects advantages and details of the novel and improved connector and method of manufacture provided by this invention appear in the following detail description of the preferred embodiments of the invention, the detailed description referring to the drawings in which.

DESCRIPTION OF THE PREFERRED EMBODIMENTS

Figure 1:
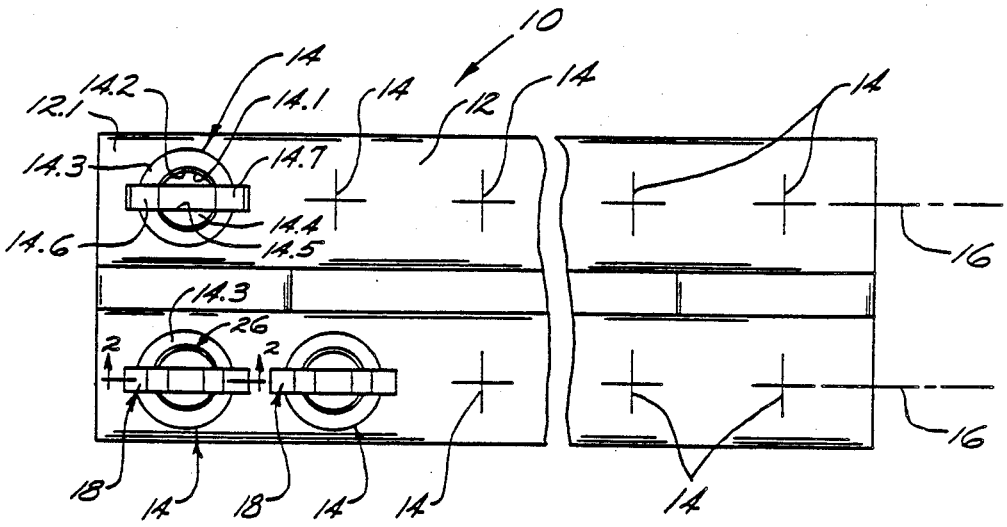
FIG. 1 is a plan view of the connector of this invention.
Figure 2:
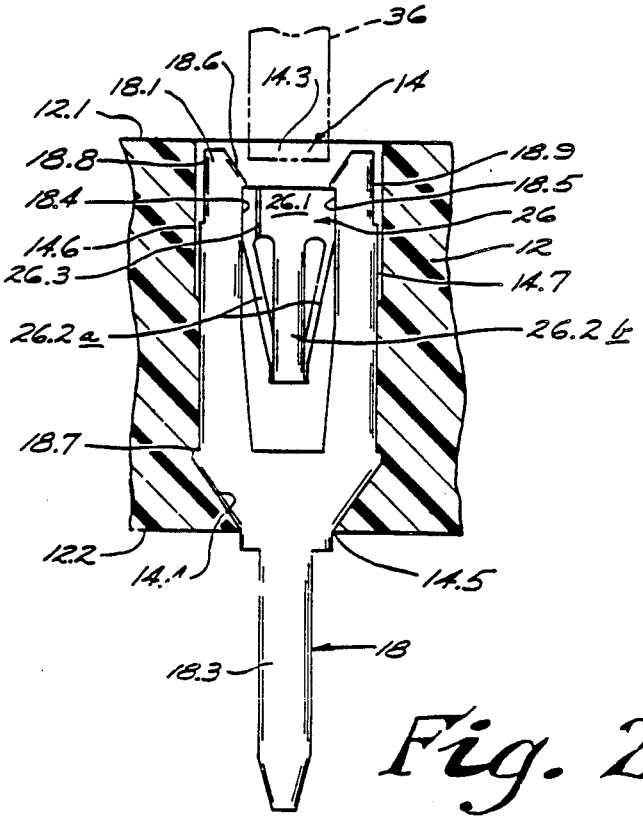
FIG. 2 is a section view to enlarged scale along line 2—2 of FIG. 1.

In FIGS. 1–2, numeral 10 indicates the connector of this invention having an electrically insulating body 12 molded or the like of a rigid electrically insulating material such as glass-filled nylon or the like. A plurality of openings 14 are spaced along the body length in a pair of grooves to extend through the body from the top side 12.1 to the bottom side 12.2. Preferably each opening has a central bore part 14.1 of selected diameter, an upper portion 14.2 of a slightly larger bore diameter, an upper tapered portion 14.3 opening at the top side 12.1, and a lower tapered portion 14.4 opening at the bottom 12.2 in a rectilinear opening 14.5. There are preferably notches 14.6, 14.7 at opposite sides of each opening at the top of the body oriented so the notches in each row are disposed in a common plane 16 along the length of the body.

A plurality of retainers 18 of an electrically conductive sheet metal such as steel, brass, or copper or the like are inserted into the respective body openings 14, one retainer being omitted from an opening shown in FIG. 1 for clarity of illustration. Preferably stiff low cost strip materials are used for the retainers. Each retainer has surfaces which are disposed in juxtaposed, spaced, facing relation to each other. Preferably the retainers are flat, have a pair of wings 18.1, 18.2 disposed in a plane in spaced side-by-side relation at one end of the retainer and have a post 18.3 extending in that plane away from the wings. Edges surfaces 18.4, 18.5 of the respective wings are juxtaposed in spaced facing relation to each other and detents such as bumps 18.6 are preferably provided on those surfaces near the distal ends of the wings. Barbs 18.7 are also preferably provided on the outer edges of the retainers for securing the retainers in body openings 14.

Figure 3:
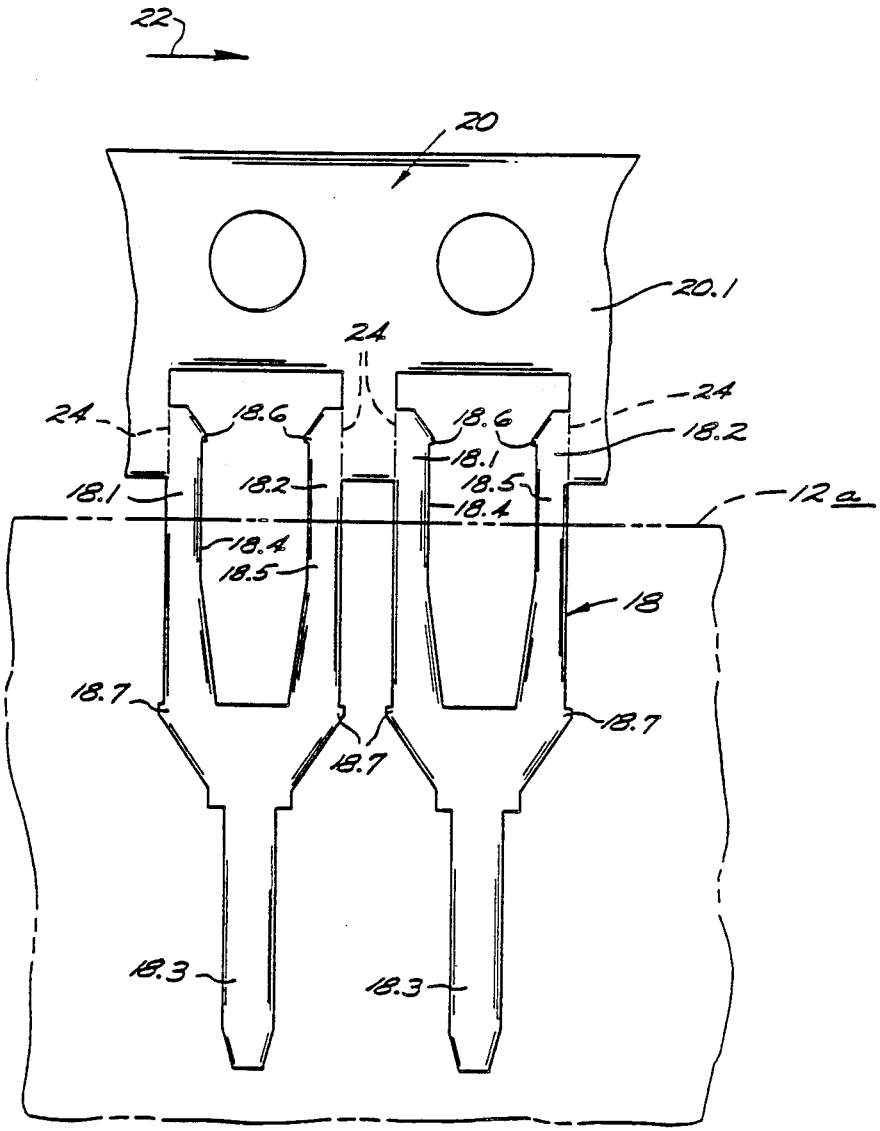
FIG. 3 is a side elevation view to enlarged scale illustrating formation and assembly of retainers used in the connector of FIG. 1.

The retainers 18 are preferably stamped or blanked in continuous sequence from a continuous strip 20 of the electrically conductive sheet metal as the strip material is advanced from a supply as diagramatically illustrated by the arrow 22 in FIG. 3. The retainers are blanked so they initially remain connected to support portions 20.1 of the strip left during the blanking. The retainers are then positioned over the connector body (as indicated in broken lines 12 a in FIG. 3) and are inserted into the body openings 14 with outer edges 18.8, 18.9 of the retainer wings received in the respective notches 14.6, 14.7. The retainers are then cut from the support strips 20.1 in any conventional manner as is diagrammatically indicated by the broken lines 24 in FIG. 3 so the retainers are separated from each other and are further inserted into the opening to the position shown in FIG. 2. In that arrangement, the group of retainers fitted into the openings in the body 12 have the same orientation in the openings, the retainer posts extend from the openings at the bottom side of the connector body to be electrically connected to an electrical circuit on a printed circuit board as will be understood, and the pairs 18.1, 18.2 of the retainer wings are disposed in the openings 14 adjacent the opposite or top side 12.1 of the body. The barbs 18.7 are seated in the body material and the retainer wings have some play in the openings 14.

Figure 4:
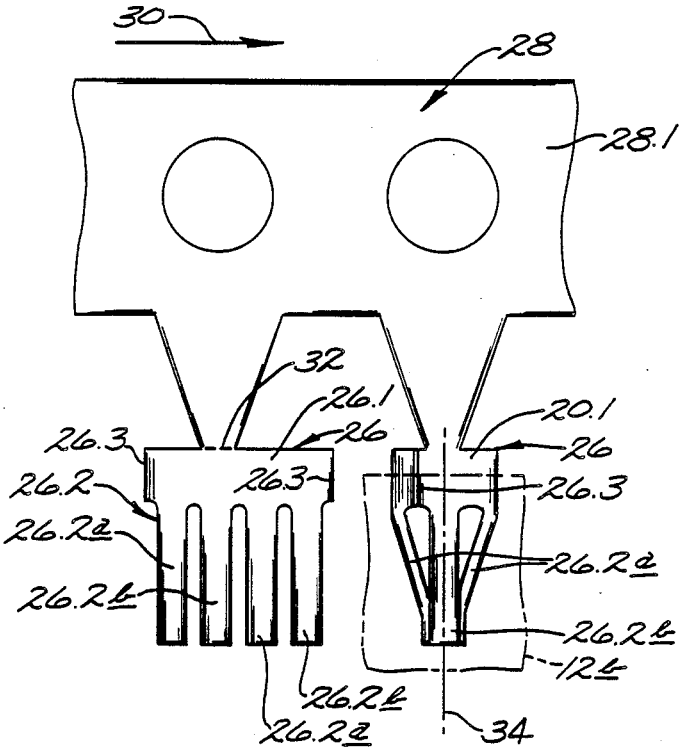
FIG. 4 is a side elevation view to enlarged scale illustrating formation and assembly of spring clips used in the connector of FIG. 1.

With particular reference to FIGS. 2 and 4, a plurality of spring clips 26 of an electrically conductive sheet metal spring material such as stainless steel, beryllium copper or phosphorus bronze or the like are also inserted into the respective body openings. Each clip has a loop portion 26.1 received between the pair of retainer wings 18.1, 18.2 in the opening and the opening and the loop configuration is selected so the loop is biased into resilient electrical engagement with the retainer wings. A plurality of integral spring leaves 26.2 extend from the loop in juxtaposed relation to each other. Preferably the spring clips 26 are stamped or blanked in continuous sequence from a continuous strip 28 of the sheet metal spring material as the strip is advanced from a supply as diagrammatically illustrated by the arrow 30 in FIG. 4. The clips are blanked and are then formed to provide the desired loop configuration 26.1 and to provide any desired prestress in the spring leaves 26.2 as is diagrammatically illustrated at 26.2 *a* and 26.2 *b* in FIG. 4. In that forming, an interruption 26.3 is left in the loop portion of each clip at a common location between two adjacent spring leaves 26.2 as shown in FIGS. 2 and 4. The clips are blanked so they initially remain connected to support portions 28.1 of the strip left during the blanking step. They are then positioned over the connector body (as indicated in broken lines 12 *b* in FIG. 4) and are inserted into the body openings 14. They are then cut or broken away from the support strip 28.1 in any conventional way as is diagrammatically illustrated by the broken lines 32 in FIG. 4 and are further inserted into the opening between the retainer wings 18.1, 18.2 under the detents 18.6 to the position shown in FIG. 2. In that arrangement, the clips 26 are inserted into the body openings 14 with the same orientation in the openings. They are firmly positioned in the openings by their engagement with the wings 18.1, 18.2 and with the walls of the inner bore section 14.2. If desired, the inner surfaces 18.4, 18.5 of the retainer wings taper in toward the post 18.3 for limiting the insertion of the clip 26 between the wings. Preferably each clip is provided with two pairs 26.2 *a*, 26.2 *b* of the integral spring leaves which are spaced at 90° from each other around a common axis indicated at 34 in FIG. 4. They are also inserted into the body openings 14 so the juxtaposed pairs of spring leaves 26.2 *a*, 26.2 *b* in each row of openings are disposed so that the broad faces of the pairs of leaves are respectively perpendicular and parallel to the planes 16 extending along the length of the connector body. The interruption 26.3 on the clip loop also has an oblique orientation relative to the plane 16. In that way, the spring leaves 26.2 are positioned so terminals of an integrated circuit unit are inserted into the body opening as indicated by broken lines 36 in FIG. 2 are adapted to be detachably and resiliently engaged by the pairs of spring leaves on each clip for electrically connecting the terminals to the noted printed circuit board circuit as will be understood. Further, if the integrated circuit unit has rows of strip-type terminals oriented in the usual way in such units, the pairs 26.2 *a*, 26.2 *b* of spring leaves are adapted to provide both edge and face engagement with such strip terminals.

In order to facilitate subsequent soldering of post 18.3 to a circuit board as well as to provide good electrical continuity between retainer 18, for example of brass, and spring clip 20, for example phosphorus bronze or berillum copper, over the expected life of the connector a tin plating is provided on retainer 18, including edge surfaces 18.4, 18.5.

Further, it is desirable to minimize electrical resistance between I.C. leads 36 and spring clips 20 so that it is preferable to provide a surface layer of high electrical conductivity material, such as gold, on spring clips 20. Although a gold layer on retainer 18 and on both surfaces of clip 20 would result in an optimum electrical path from the I.C. to the circuit board through clips 26 and retainer 18, the cost of plating retainer 18 with a gold layer becomes prohibitive. A further problem to be dealt with is that if the clip is provided with layers of gold on both inner and outer surface areas the gold-tin interface between clip 26 and retainer 18 forms a galvanic cell which can eventually result in corrosion thereby increasing the resistance in the electrical circuit between the I.C. and the printed circuit board from an acceptable level of 30 milliohms, for example, to hundreds of milliohms or, in effect, an infinite resistance thereby resulting in a failure.

Figure 5:
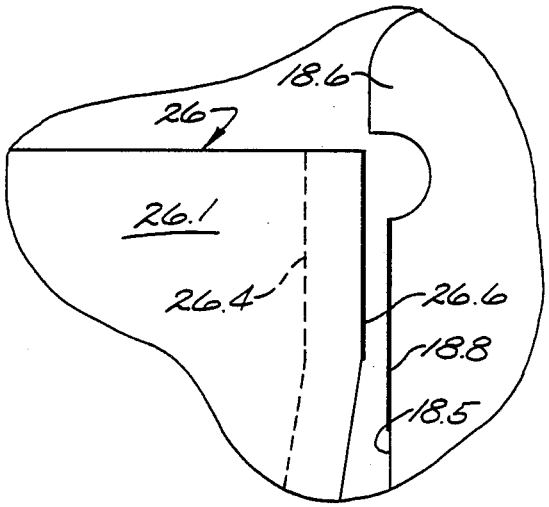
FIG. 5 is an enlarged view of a portion of a retainer and a clip.

The present invention eliminates this problem while still providing solderability and an excellent low resistance path from the I.C. to the printed circuit board. As seen in FIG. 5 clip 26 is provided with a layer 26.4 of gold on its inside surface area and a layer 26.6 of tin on the outer surface area of loop 26.1. A layer 18.8 of tin is also formed on retainer 18 including the upper portion of edge surfaces 18.4, 18.5 alignable with loop 26.1. It has been found that a 100 microinch thick plated layer of tin for layer 26.6 is satisfactory. Preferably a slightly thinner layer, for example in the order of 50 microinch thick for layer 18.8, is employed in order to avoid tin build up on assembly equipment due to friction with the retainer.

It should be understood that although particular embodiments of the connector and methods of this invention have been described by way of illustrating invention, this invention includes all modifications and equivalents of the described embodiments falling within the scope of the appended claims.

What is claimed:

1. A high reliability low cost connector comprising an electrically insulating body having an opening, an electrically conductive retainer formed of sheet metal having a pair of wings lying in a common plane extending from the retainer in one direction with respective surfaces of the wings juxtaposed in spaced facing relation to each other and having an integral post extending from the retainer in an opposite direction, the wing surfaces in spaced facing relationship to each other having a tin layer on at least a portion thereof, the retainer being attached to the body in the body opening with the post extending from the opening at one side of the body to be connected in an electrical circuit and with the retainer wings disposed in fixed position in the opening adjacent an opposite side of the body with said plane of the retainer wings extending along the longitudinal axis of the opening, and a spring clip having a loop of an electrically conductive sheet metal spring material having an inside surface and an outside surface, the inside surface having a layer of gold on at least a portion thereof and the outside surface having a layer of tin on at least a portion thereof, the spring clip disposed in the opening between the retainer wings with portions of the loop having said tin layer biased into resilient electrical engagement with the respective spaced facing surfaces of the retainer wings having said tin layer to position the loop to extend in a plane normal to the longitudinal axis of the opening and to said plane of the retainer wings, the spring clip having a plurality of integral spring leaves having said gold layer extending from the loop in juxtaposed relation to each other to make detachable, resilient electrical engagement to a terminal inserted between the spring leaves to electrically connect the terminal in said electrical circuit.

2. A connector according to claim 1 in which the tin layer on the loop is approximately 100 microinches in thickness and the tin layer on the retainer edge surfaces is approximately 50 microinches in thickness.

3. A high reliability low cost connector comprising an electrically insulating body having a plurality of openings extending between opposite sides of the body and spaced in a pair of rows which extend along a length of the body, a plurality of flat electrically conductive retainers formed of sheet metal each having a pair of wings disposed in spaced relation to each other lying in a common plane extending from the retainer in one direction with respective edge surfaces of the wings juxtaposed in spaced relation to each other and having an integral post extending in an opposite direction from the wings in said plane, the edge surfaces of the wings in spaced facing relation to each other having a tin layer on at least a portion thereof, the retainers being attached to the body in the respective body openings with the post thereof extending from the respective openings at one side of the body and with the retainer wing pairs received within the respective openings at the opposite side of the body extending along a longitudinal axis of the opening, and plurality of spring clips each having a loop of resilient, electrically conductive sheet metal spring material having an inside surface and an outside surface, the inside surface having a layer of gold on at least a portion thereof and the outside surface having a layer of tin on at least a portion thereof, the spring clips disposed within a respective body opening at said opposite sides of the body between the pair of retainer wings in the opening with portions of the clip loop having said tin layer biased into resilient electrical engagement with the respective spaced facing surfaces of the pair of retainer wings having said layer in the opening to position the loop to extend in a plane normal to the longitudinal axis of the opening and to the plane of the retainer wings in the opening, the spring clips each having a plurality of integral spring leaves having said gold layer extending from the loop thereof in juxtaposed relation to each other to make detachable, resilient electrical engagement to a terminal inserted into a body opening between the spring leaves of the clip to electrically connect the terminal in the electrical circuit.

4. A connector according to claim 3 wherein the retainers are disposed in the body openings with said pairs of retainer wings extending in the direction of said length of the insulating body.

5. A connector according to claim 3 having detent means on said surface portions of the retainers wings engaging the spring clips for detachably retaining the spring clips in selected position in the body openings in electrical engagment with the retainer wings.

6. A connector according to claim 3 in which the tin layer on the loop is approximately 100 microinches in thickness.

7. A connector according to claim 3 in which the tin layer on the retainer edge surfaces is approximately 50 microinches in thickness.

* * * * *